United States Patent [19]

Sansome et al.

[11] Patent Number: 4,745,787

[45] Date of Patent: May 24, 1988

[54] PLUG DRAWING

[75] Inventors: Dennis H. Sansome, West Midlands, England; Thiam B. Lim, Singapore, Singapore

[73] Assignee: National Research Development Corporation, London, England

[21] Appl. No.: 16,485

[22] Filed: Feb. 17, 1987

Related U.S. Application Data

[63] Continuation of Ser. No. 729,851, May 2, 1985, abandoned.

[30] Foreign Application Priority Data

May 2, 1984 [GB] United Kingdom ..... 8411289

[51] Int. Cl.[4] ..... B21C 9/00; B21C 1/24

[52] U.S. Cl. ..... 72/41; 72/283

[58] Field of Search ..... 72/283, 276, 370, 41, 72/43, 45

[56] References Cited

U.S. PATENT DOCUMENTS

| | | | |
|---|---|---|---|
| 2,306,712 | 12/1942 | Poncar | 72/283 |
| 2,355,734 | 8/1944 | Katz | 72/283 |
| 2,679,681 | 6/1954 | Resler | 72/370 |
| 3,293,894 | 12/1966 | Edgecombe et al. | 72/283 |
| 3,783,663 | 1/1974 | Prajsnar et al. | 72/283 |

FOREIGN PATENT DOCUMENTS

| | | | |
|---|---|---|---|
| 719140 | 10/1965 | Canada | 72/283 |
| 3016135 | 10/1981 | Fed. Rep. of Germany | 72/283 |
| 24931 | of 1898 | United Kingdom | 72/276 |
| 587785 | 5/1947 | United Kingdom | 72/283 |
| 1432375 | 4/1976 | United Kingdom | 72/283 |
| 1507576 | 4/1978 | United Kingdom . | |
| 2016339 | 9/1979 | United Kingdom . | |
| 153906 | 1/1963 | U.S.S.R. | 72/283 |

*Primary Examiner*—Daniel C. Crane

*Attorney, Agent, or Firm*—Cushman, Darby & Cushman

[57] ABSTRACT

A plug assembly for use in the plug drawing of tubes and like hollow workpieces. In axial succession, from front to rear, the plug comprises three parts in fixed relationship to each other: a foremost first part with a smoothly rounded nose to make smooth and positive contact with the tube at the start of drawing, a parallel-sided middle part which sizes the interior section of the product as drawing proceeds, and a long rearmost part of larger section. During drawing the confronting surfaces of the rear part and the bore of the undrawn tube define a thin cylindrical clearance, relative movement between the walls of which exercises a hydrodynamic action upon lubricant lying within the tube rearward of the plug, forcing that lubricant forward through the clearance into the region where tube and plug first make contact. Alternative plug shapes for the third part of the plug are proposed, including parallel-sided, stepped and sloping.

12 Claims, 5 Drawing Sheets

PLUG DRAWING

This is a continuation of application Ser. No. 729,851, filed May 2, 1985, which was abandoned upon the filing hereof.

This invention relates to the plug-drawing of elongated products of hollow section such as tubes, and to plug assemblies for use in such drawing.

Plug-drawing of tubes is a well established industrial process. In such drawing, essentially the tube is drawn simultaneously through a die which makes contact with its outer surface, and over a plug which makes contact with its inner surface, so that the outer and inner sections of the drawn tube match the sections of the die cavity and of the plug respectively. As drawing proceeds the plug is commonly fixed in position, for instance by means of a rod or bar fixed at one end to the plug and passing up the bore of the undrawn tube to be anchored to fixed structure at its other end. Floating plugs are also known however: they are designed so that the friction of their contact with the inner wall of the tube being worked draws them into the transverse plane of the die, and their shape holds them there without further support as drawing proceeds.

Although the process is so well known, difficulty is still encountered in lubricating the bore of the tube. High friction, pick up and chatter resulting from contact between the tube and the plug not only restrict the reduction in section obtainable per pass of the tube through the die, but also damage both the tube and the plug. In the case of stainless steel and some other alloy tubes, these difficulties are aggravated by the tendency of the material to work-harden rapidly.

One of the best known methods of applying lubrication is to coat the inner surface of the tube prior to drawing with various mixtures in which lubricants such as soap or oil are mixed with low shear-strength compositions: typically lime, phosphates, or complex oxalates, or compounds of zinc, copper or lead. However, such surface coatings can be expensive, and cumbersome to apply and remove, and disposal of the effluents can also be difficult. Costs are therefore high. As a means of increasing the quantity of lubricant that achieves access to the interface between the tube and plug, pockets have been formed in regular patterns on the inner surface of the tube and filled with lubricants before drawing begins: such pockets have been formed, for example, by grit blasting the bore of the undrawn tube or pickling it in an acid bath. Substantial improvements in lubrication have sometimes been achieved in this way, but the process has understandably been time-consuming and expensive.

The present invention is aimed at achieving efficient lubrication at the interface of the plug and the tube in a novel and simpler way, by causing a substantial volume of lubricant to reside at all times in the vicinity of the interface of the moving tube and the plug, and by using the relative motion of tube and plug to enhance the pressure of that fluid and thus the force with which it tends to enter the interface. According to the invention a plug assembly for use in the plug-drawing of elongated workpieces of hollow section has a first and foremost part, presenting a smoothly and convexly curved surface adapted in use to make first contact with the workpiece as a drawing operation commences; that first part merging smoothly at its rearward end into a parallel-sided second part, equal in external section to the internal section of the drawn workpiece and adapted in use to make contact with the bore of the drawn workpiece; and a third and yet more rearward part, of substantial axial length and having a maximum section which is substantially greater than the section of the second part but slightly less than the section of the undrawn workpiece so as to leave an axially-long annular clearance between the third part and the undrawn workpiece.

The first second and third parts may be integral, or at least two of them may be distinct but fixed together.

The third part may be parallel sided and may be of stepped form, the steps increasing in section from the most rearward forwards. Alternatively, the third part may be tapered, being of smallest section towards its rearward end and gradually increasing in section towards the forward end. The third part may include both parallel sided and tapering sections.

The third part may be attached to a plug bar by means of which the plug assembly is axially restrained as the product is drawn over it.

The forward end or nose of the first part may be bullet-shaped or similarly rounded, the radius of the curve when measured in a plane including the drawing axis preferably being great compared with the internal diameter of the drawn workpiece.

The invention also includes a method of drawing elongated workpieces of hollow section, using such a plug assembly.

The invention will now be described, with reference to the accompanying drawings in which.

Figure 1:
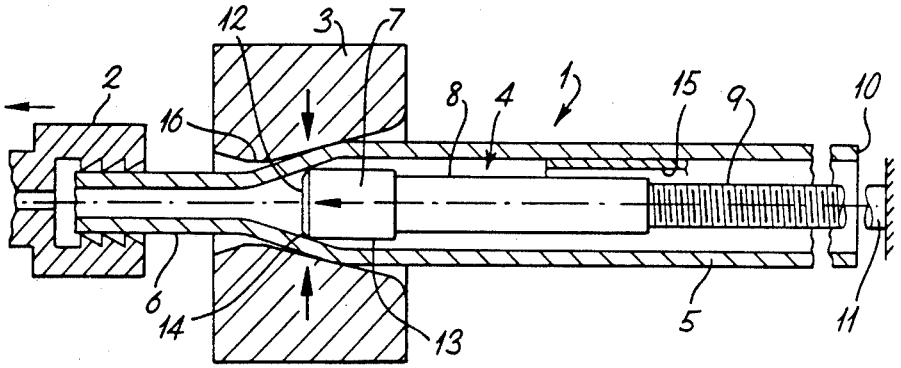
Fig. 1 (PRIOR ART)
FIG. 1 is a diagrammatic axial section through a tube about to be drawn over a conventional plug.

FIG. 1 shows a tube 1 about to be drawn by powered jaws 2 through a die 3 and over a conventional plug assembly 4. In preparation for drawing, the forward end of the undrawn part 5 of the tube has been necked down to form a tag 6 which can pass through the orifice of the die 3 and be gripped by the jaws 2. The plug assembly comprises the plug 7 itself, attached to a mounting shank 8 which is in turn attached to a plug bar 9 which protrudes from the upstream end 10 of the undrawn part 5 of the tube and is anchored to fixed structure at 11. Plug 7 has a transverse front face 12 and a parallel side wall 13, separated by a sharp-cornered 45° chamfer 14. While it is known to supply lubricant to the interface between the tube and the plug in other ways—for instance by continuously feeding liquid lubricant into the bore of the tube through the upstream end 10 while drawing proceeds—one typical way of supplying lubricant is to coat the inner surface of the tube with a thin layer 15 of grease, soap or the like before drawing. At the moment drawing begins, the components are typically in the relative position shown in FIG. 1, with the inner wall of the tapering part of the tube just in line contact with the sharp corner between the chamfer 14 and the plug side wall 13.

Figure 2:
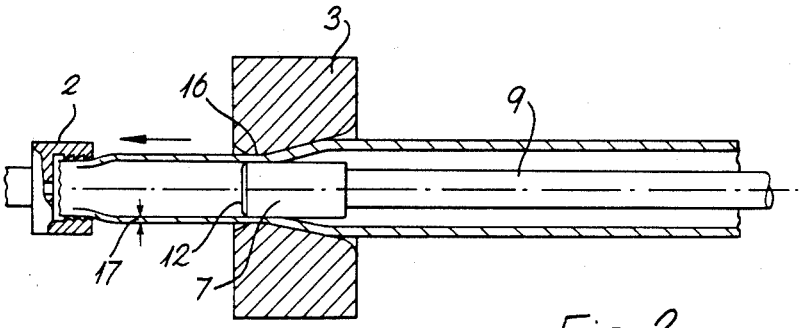
Fig. 2 (PRIOR ART)
FIG. 2 is a similar view taken once drawing has begun.

When the jaws 2 start to draw the tube, the plug quickly moves to the position shown in FIG. 2. Frictional drag of the moving tube upon the plug 7 causes the plug bar 9 (which may in practice be very long) to elongate slightly so that in the steady state drawing condition the forward face 12 and chamfer 14 of the plug lie axially downstream of the narrowest part of the land or bearing 16 of the die orifice, so that the radial clearance between the plug side wall 13 and the land 16 defines the thickness of the wall 17 of the drawn tube.

Efficient drawing demands a thin but unbroken film of lubricant at all times over the entire cylindrical area of contact between plug 7 and the inner wall of the tube. Failure to achieve this leads to high drawing loads and many other known disadvantages. In practice the applied lubricant layer 15 and some drag upon that layer due to the motion of the tube help to promote such a film, but the action is haphazard and is not helped by the fact that the lubricant immediately upstream of the area of contact is subject only to ambient pressure or little more. Another disadvantage of the known apparatus described so far is the line contact, already referred to and illustrated in FIG. 1, which exists between the usually distinct corner on the plug and the inner wall of the tube just before drawing is to start. As drawing then begins and the plug assembly lengthens in the manner already described, the inner wall of the tube sometimes collapses upon the distinct corner and the high pressure involved results in intimate metal contact between the two surfaces. Such high pressure contact tends to create an erratic seal between the two contacting bodies and also enhances the possibility of damage, of the kind known in the art as pick-up, between the plug and the tube. Such damage if started tends to continue along the entire length of the drawn tube even after the steady state condition has been reached when, as FIG. 2 shows, sharp edge contact between the plug and tube no longer exists.

Figure 3:
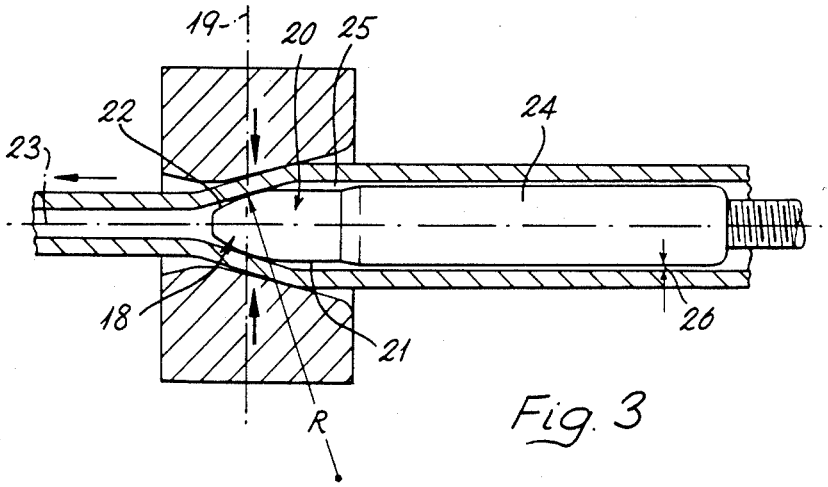
FIG. 3 is a similar view of a tube about to be drawn over a plug assembly according to the present invention.

Two important and novel features of a plug assembly according to the present invention are shown in outline in FIG. 3. Essentially the assembly comprises three parts arranged in axial sequence and in fixed relationship to each other. The first and foremost part 18 presents a smoothly and convexly-curved forward surface 22 having a radius R which, taken in a plane including the drawing axis 23, is at least of the same order as the diameter of the undrawn tube and preferably greater. The line contact between the tube and the conventional plug 7 at the start of drawing is now therefore replaced by a larger area of contact, reducing the intensity of the contact stress between the two surfaces as the tube collapses onto the part 18. This diminishes the likelihood that pick-up will begin, and thereafter continue. It also tends to promote a reliable seal between tube and plug, which is important to the invention for a reason which will be explained.

The second part 20, into which the surface 22 of the first part 18 merges smoothly around transverse plane 19, has a parallel-sided surface 21. As FIGS. 4 and 5 show, in use this surface 21 makes contact with and defines the cross-section of the inner surface of the wall 17 of the drawn tube.

A further difference between the plug assembly of FIG. 3 and that of the preceding Figures is that upstream of the first and second parts already described, in place of the shank 8, is a third part 24 which will be referred to as the plug attachment. Whereas the radial clearance between shank 8 and the bore of the undrawn tube was considerable—in fact, greater than that between the bore and the plug 7 itself—the clearance 26 between attachment 24 and the bore is narrow. The annular space 25 which lies forward of plug attachment 24 and is bounded by the bore, the side wall 21 of second part 20 and the forward end of the attachment, is thus almost an enclosed space, being effectively sealed at its forward end by the interface between surface 22 and the bore of the tube and communicating with ambient pressure at its rearward end only by means of a long and narrow passage. When drawing now begins, and there is relative motion between plug assembly and tube, that motion tends to set up a substantial hydrodynamic action, drawing lubricant 15 into the space 25 by way of clearance 26 more readily than that lubricant can leave the space forwardly by way of the good seal between the tube bore and the smoothly curved surface 22. The result is to tend to raise the lubricant within space 25 to a pressure above ambient, so increasing the force with which that lubricant tends to promote a thin but continuous working film of lubricant between the tube bore and the plug. This improved lubrication, while particularly beneficial as drawing begins, persists when the steady state is reached as shown in FIGS. 4 and 5, when the curved nose 22 of the first part 18 is no longer in contact with the bore of the tube and when, as in FIGS. 1 and 2, the dimension of the wall 17 of the drawn tube is defined by the clearance between the side wall 21 of the second part 20 and the land 16 of the die.

Figure 4:
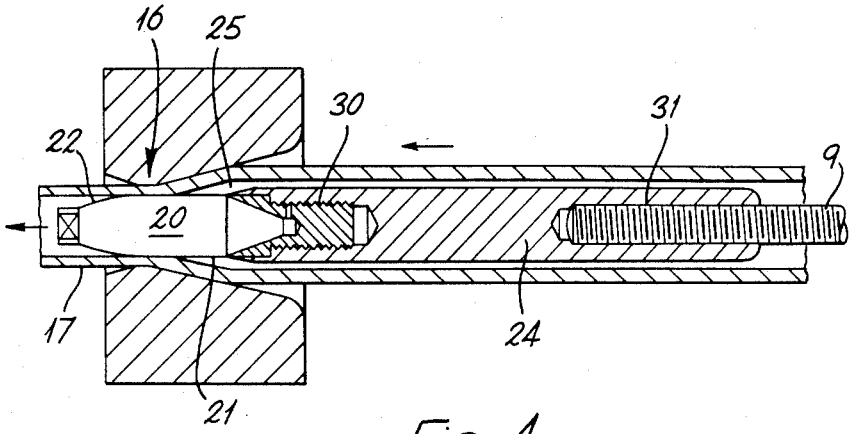
FIG. 4 is a more detailed axial section through the parts shown in FIG. 3.
Figure 5:
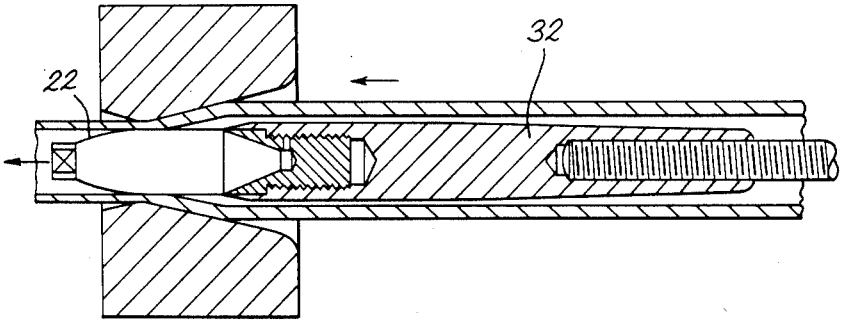
FIG. 5 is a view similar to FIG. 4, but showing another plug according to the present invention.

FIGS. 4 and 5 show two plug assemblies according to the present invention in greater detail. In FIG. 4 there is a screw-threaded engagement 30 between the second part 20 and the attachment 24, which is parallel sided as in FIG. 3 and which in turn makes a threaded engagement 31 with plug bar 9. The "third part" or attachment 32 of FIG. 5 engages similarly with the second part 20 and with the bar 9 but also includes a rearward part of tapered shape so that the clearance between it and the bore of the undrawn tube is smaller at its downstream end than at its upstream end. In both these Figures, as in FIG. 3 and indeed all other Figures to be described, first and second parts 18 and 20 are integral with each other, although it is of course within the scope of the invention that they could be separate but rigidly connected.

Figure 6:
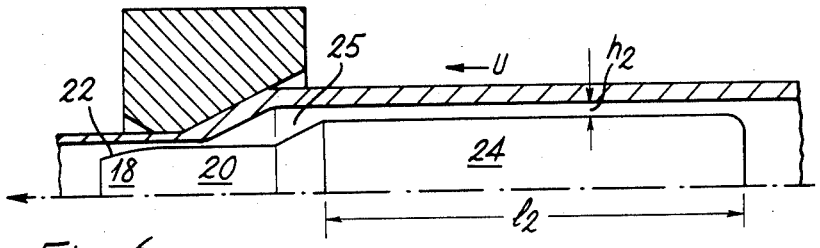
FIGS. 6 to 9 are diagrammatic axial sections through alternative plug assemblies having similarities to that of FIG. 4.
Figure 7:
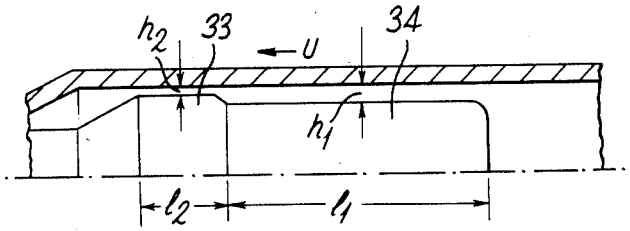
Figure 8:
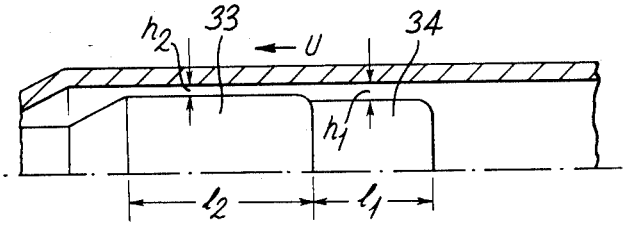

The lubricant pressure which can be generated within space 25 and at the plug/bore interface by hydrodynamic action—that is to say, the effects on the lubricant of the relative motion of the plug and the tube—varies directly with the length of the attachment 24 or 32, the draw speed or the velocity of the undrawn tube, and the viscosity of the lubricant, and inversely with the radial clearance between the attachment and the bore of the undrawn tube. Industrially it is desirable to have lubicant pressures which are as high as possible since friction at the plug/bore interface is then lowest. On the other hand it is desirable also to use an attachment which is as short as possible, and which provides a radial clearance as large as possible, so as to minimise practical difficulties associated with mounting the plug assembly within the tube prior to drawing and maintaining accurate alignment during drawing. Increasing the drawing speed and/or the viscosity of the lubricant permits the length of the attachment to be shortened and the radial clearance to be increased. A practical attachment design therefore demands a compromise among these factors, and FIGS. 6 to 9 and 10 to 13 illustrate some practical means of achieving such compromises. FIGS. 6 to 9 illustrate "third parts" or attachments 24 having parallel sides, all of which will tend to generate the same pressure within space 25 when used comparably, that is to say with the same lubricant and at the same drawing speed U and with all other relevant parameters the same. In FIG. 6 the axial length $l_2$ and the radial clearance $h_2$ between the attachment and the bore are both relatively large, and in FIG. 9 they are both relatively small. Between these extremes lie the designs of FIGS. 7 and 8 in which the attachment is stepped comprising a first and more forward step 33 separated from the bore by a relatively small clearance $h_2$ (of the order of the same clearance in FIG. 9) and a second and more rearward step 34 presenting a relatively large clearance $h_1$ (of the order of the same clearance in FIG. 6). In FIG. 7 the ratio between the axial lengths $l_2$ and $l_1$ of steps 33 and 34 is less than unity whereas in FIG. 8 the same ratio is greater than unity, and the total axial length of the attachment is less than in FIG. 7 but greater than in FIG. 9.

Figure 9:
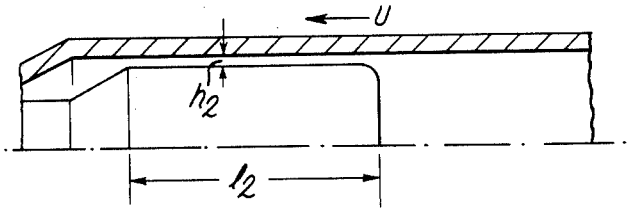
Figure 10:
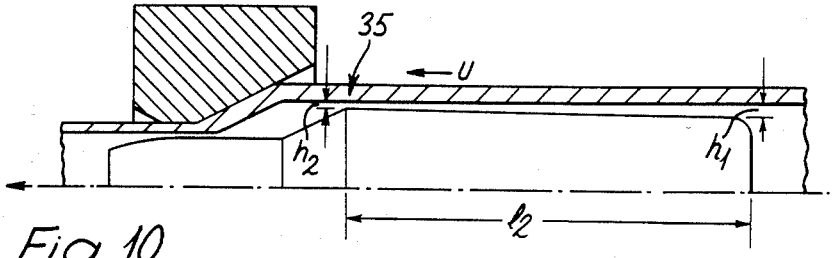
FIGS. 10 to 13 are diagrammatic axial sections through alternative plug assemblies of the general kind shown in FIG. 5, and FIGS. 14 and 15 are graphs.
Figure 11:
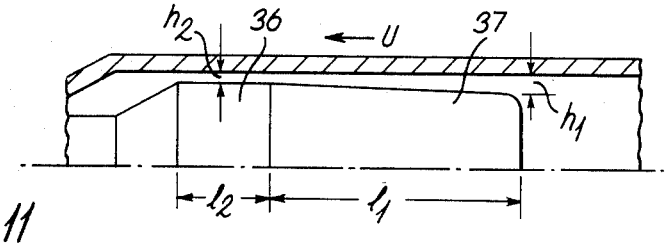
Figure 12:
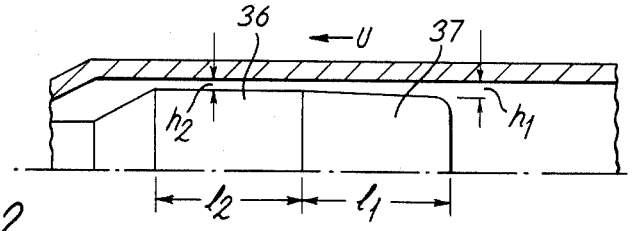

In FIGS. 10 to 13 the attachment 32 includes a taper as in FIG. 5. In FIG. 10 it is tapered over its entire effective length, the clearance between the attachment and the bore of the undrawn tube being greatest ($h_1$) at the extreme rearward end and least ($h_2$) at the effective forward end 35 which marks the rear boundary of the space 25. The attachment of FIG. 11 is axially shorter because it is in two sections, the forward section 36 being parallel sided and of axial length $l_2$ and presenting the clearance $h_2$ while the rearward section 37 is of axial length $l_1$ and is tapered, presenting a clearance $h_1$ at its own rearward end. The attachment of FIG. 12 is shorter still because the ratio of the lengths $l_1$, and $l_1$ of sections 36 and 37 is now approximately unity instead of being less than unity in FIG. 11. It will be seen that the extreme and shortest case shown in FIG. 13, including only a parallel-sided section 36 of length $l_2$ and presenting a clearance $h_2$, is exactly the same as the extreme case of the parallel-sided and stepped designs of attachment shown in FIG. 9.

Figure 14:
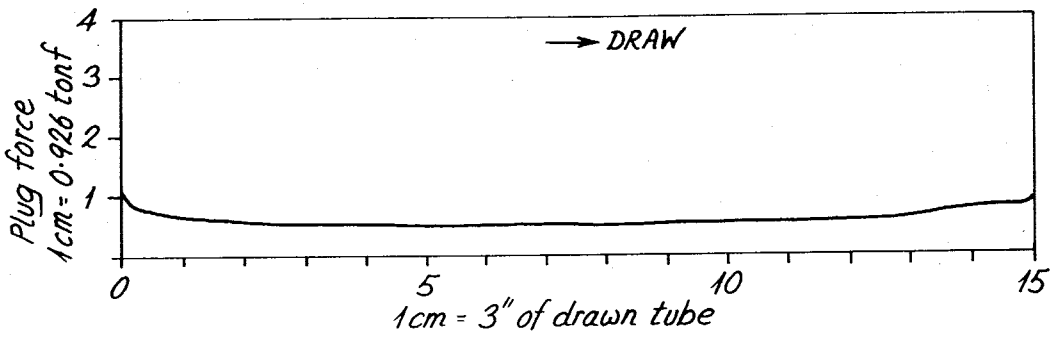
Figure 15:
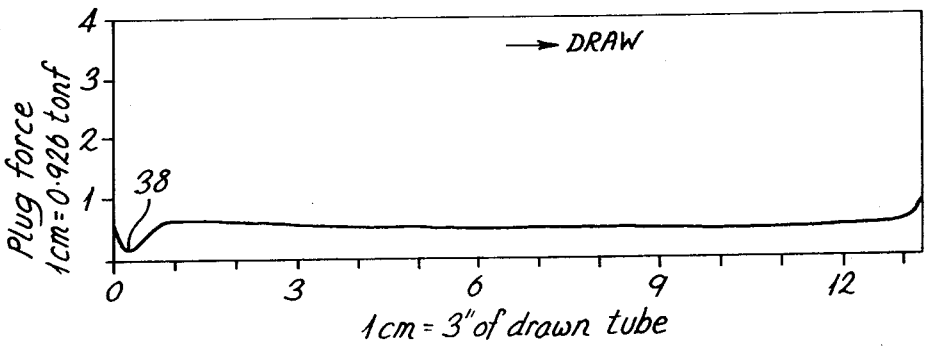

The improved lubrication provided at the start of a drawing operation by the bullet-nosed design of plug assembly (having a first part 18 presenting a smoothly-curved surface 22) as already described is illustrated by comparing FIG. 15, which relates to the use of such an assembly, with FIG. 14 which relates to a conventional plug as shown for example in FIGS. 1 and 2. Each of these graphical figures relates to the first few moments of a drawing operation in which tube of A1S1 Austenitic stainless steel was drawn from an initial OD/thickness of 0.830/0.093 inches to a final 0.687/0.078 inches at a drawing speed of 15 feet minute$^{-1}$. Plug force is the longitudinal force tending to pull the plug bar 9 away from its anchorage at 11, and is a measure of the friction at the plug/tube interface since that is the only longitudinal force acting on the plug assembly. The action of the pressurised lubricant in space 25 to reduce the interfacial friction between the plug and the tube is indicated by the depression 38 in the plug force as the start of the draw using a plug according to the present invention. While the magnitude of the steady state plug force is of the same order in both of FIGS. 14 and 15, FIG. 14 contains no equivalent of the depression 38 close to the start of drawing.

Figure 13:
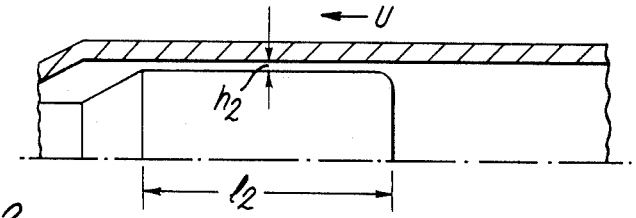

As to the steady state condition, once the surface 22 is no longer in contact with the tube bore, analysis indicates that for a straight-wall attachment as shown in FIGS. 6, 9 and 13 the pressure P generated within space 25 is given by the equation $$P = -\frac{1}{\Phi}\ln\left[1 - \frac{6\eta_o\Phi U l_2}{h_2^3}\cdot z\cdot\left(\frac{h_2}{z} - h_4\right)\right] \quad \text{(i)}$$

where in addition to the quantities already defined $\Phi$ is a viscosity-pressure coefficient, $\eta_o$ is the dynamic viscosity of the lubricant at atmosphere pressure, z is the ratio of the initial to the final internal radii of the tube, and $h_4$ is the thickness of the lubricant film separating the surface 21 of part 20 and the inner wall of the drawn tube at their interface.

For an attachment tapered over its entire length, as shown for examples in FIG. 10, the corresponding pressure P is given by the equation $$P = -\frac{1}{\Phi}\ln\left\{1 - \frac{3\eta_o\Phi U l_2}{h_2^3(1+k)^2}\cdot z\cdot (2+k)\left[\frac{2(1+k)}{(2+k)}\cdot\frac{h_2}{z} - h_4\right]\right\} \quad \text{(ii)}$$

where in addition to terms already defined $k=(h_1/h_2)-1)$ and thus defines the angle of the taper. For a purely stepped attachment, as shown for example in FIGS. 7 and 8, the corresponding formula is $$P = -\frac{1}{\Phi}\ln\left\{1 - 6\eta_o\Phi U z\left[\frac{l_1}{h_1^3}\left(\frac{h_1}{z} - h_4\right) + \frac{l_2}{h_2^3}\left(\frac{h_2}{z} - h_4\right)\right]\right\} \quad \text{(iii)}$$

and for the kind of attachment shown in FIGS. 11 and 12, including a forward parallel-sided section of axial length $l_2$ and a more rearward tapering section of axial length $l_1$, the corresponding equation is $$P = -\frac{1}{\Phi}\ln\left\{1 - 3\eta_o\Phi U z\left\{\frac{l_1}{h_2^3}\cdot\frac{(2+k)}{(1+k)^2}\cdot\left[\frac{2(1+k)}{(2+k)}\cdot\frac{h_2}{z} - h_4\right] + \ldots + \frac{2l_2}{h_2^3}\left(\frac{h_2}{z} - h_4\right)\right\}\right\} \quad \text{(iv)}$$

From the examples given it will be clear that in practice the total axial length—$l_2$ in some examples, $l_1+l_2$ in others—of the "third part" or attachment must be considerable. Typically it will be of the order of five or more times the inner diameter of the undrawn tube. It will also be apparent that the fixed geometry of the first, second and third parts of the plug not only makes for simplicity and cheapness, but also makes the shape and size of the vital annular space 25 more constant and predictable, with obvious advantages to the stability and ascertainability of the pressure maintained within that space, and to the controllability of the drawing process as a whole.

The aspect of the invention by which enhanced lubricant pressure is established in the space (25) immediately adjacent the plug assembly workpiece interface is of use not only when the lubricant is applied as a soap or grease to the inner surface of the tube prior to drawing, but also when it is supplied in other ways, for instance by being introduced under gravity or under some pressure at the open end of the undrawn tube. As well as leading to advantages that have already been referred to, tests have indicated reductions in the draw stress required for a given drawing operation. It should be borne in mind however that another consequence of the use of the invention to raise the value of $h_4$, the interfacial oil film thickness, above normal is that the surface finish of the bore of the drawn tube, while acceptably lustrous, will sometimes be of duller appearance than results from conventional plug drawing in which the value of $h_4$ is lower.

We claim:

1. In combination a plug assembly and a die for use in the process of plug-drawing elongated tubular workpieces, said plug assembly comprising:

a first and most forward portion having a smoothly and convexly curved forward surface and a rearward end portion;

said first portion merging smoothly at said rearward end portion into a parallel-sided second portion;

a third and more rearward portion, the most forward end of the third portion having a cross-section substantially equal to the cross-section of said second portion, the cross-section of the third portion gradually increasing from said forwardmost end to a maximum outer cross-section at the rearwardmost end thereof;

a fourth and yet more rearward portion having a length that is at least five times greater than the inner diameter of the workpiece to be drawn and having a maximum outer cross-section which is substantially greater than the outer cross-section of said second portion; and plug bar means coupled to a rearward most end of said plug assembly for holding said plug assembly fixed relative to said die and radially spaced therefrom, said plug being positioned relative to said die by said plug bar so that during the plug-drawing process, said workpiece makes cross-section defining contact with said second portion of said plug assembly, said cross-section defining contact being the rearwardmost contact that said plug assembly makes with said workpiece during said plug-drawing process, and contact of said workpiece with said third portion and said fourth portion is avoided.

2. A plug assembly as claimed in claim 1, wherein said first, second, third, and fourth portions are integral.

3. A plug assembly as claimed in claim 1, wherein at least two of the first, second, third, and fourth portions are distinct elements that are coupled together.

4. A method of plug-drawing an elongated tubular workpiece comprising:

providing a tubular workpiece to be drawn;

forming a plug assembly including a first and most forward portion having a smoothly and convexly curved forward surface, adapted to make forwardmost contact with said workpiece as said drawing commences, and having a rearward end section, said first portion merging smoothly at said rearward end section to a parallel-sided second portion, said second portion having an outer cross-section equal to the inner cross-section of said tubular workpiece when drawn and adapted to make cross-section defining contact with said inner cross-section of said tubular workpiece when drawn, said cross-section defining contact being the rearwardmost contact that said plug assembly makes with said workpiece during said plug drawing process, a third and more rearward portion, the forwardmost end of the third portion having a cross-section substantially equal to the cross-section of said second portion, the cross-section of the third portion gradually increasing from said forwardmost end to a maximum outer cross-section being slightly less than the inner cross-section of said workpiece before it is drawn, so as to provide an annular space between said forwardmost end of said third portion and said undrawn workpiece when the plug assembly is placed within the bore of the workpiece, and a fourth and most rearward portion having a length that is substantially greater than the inner diameter of said workpiece before being drawn and having a maximum outer cross-section which is substantially greater than said outer cross-section of said second portion but slightly less than said inner cross-section of said undrawn workpiece, so as to provide an elongated annular clearance between said fourth portion and said undrawn workpiece when the plug assembly is placed within the bore of the workpiece;

placing a lubricant within the bore of the undrawn tubular workpiece;

placing the plug assembly within the bore of the workpiece so that said annular space and said annular clearance are in circumferentially-unobstructed communication;

placing said workpiece and plug assembly within a die; and drawing the tubular workpiece through said die and over said plug assembly so that the cross-section defining contact is the rearwardmost contact that the plug assembly makes with said workpiece and contact between said workpiece and said third and fourth portions of said plug assembly is avoided and whereby the lubricant is drawn by the relative motion of said workpiece and said plug assembly along said annular clearance into said annular space through said circumferentially unobstructed region and adjacent the locus of said cross-section defining contact between said workpiece and said second portion of said plug assembly and is maintained in said annular space at a pressure above ambient pressure by means of the hydrodynamic action upon it by said relative motion of said workpiece and said plug assembly.

5. A method of plug-drawing as claimed in claim 4, wherein the step of forming the plug assembly further includes the steps of forming at least two of the four portions thereof as distinct elements and fixedly coupling the portions together.

6. A method of plug-drawing as claimed in claim 4 wherein the step of forming the plug assembly further includes forming the fourth portion with parallel sides.

7. A method of plug-drawing as claimed in claim 4, wherein the step of forming the plug assembly further includes forming the fourth portion with a stepped outer cross-section.

8. A method of plug-drawing as claimed in claim 7, wherein said fourth portion is formed so as to increase in outer cross-section from the most rearward end thereof to the most forward end.

9. A method of plug-drawing as claimed in claim 4, wherein the step of forming the plug assembly further includes forming the fourth portion with a tapered outer cross-section, said taper being of smallest cross-section at the rearwardmost end of the fourth portion and gradually increasing in cross-section towards the forward end thereof.

10. A method of plug-drawing as claimed in claim 4 wherein said step of forming the plug assembly further includes forming the fourth portion with both parallel-sided portions and tapered portions.

11. A method of plug-drawing as claimed in claim 4 wherein the step of forming the plug assembly further includes forming the fourth portion with a length that is at least five times the inner diameter of said undrawn workpiece.

12. A method of plug-drawing as claimed in claim 4, further including the step of attaching the plug assembly to a plug bar member.

* * * * *